US005590813A

United States Patent [19]

Abramczyk

[11] Patent Number: 5,590,813

[45] Date of Patent: Jan. 7, 1997

[54] DISPENSER

[76] Inventor: Robert J. Abramczyk, 17699 Teppert, Detroit, Mich. 48234-3845

[21] Appl. No.: 445,774

[22] Filed: May 22, 1995

[51] Int. Cl.[6] ..... B65H 1/00

[52] U.S. Cl. ..... 221/197; 229/122.2

[58] Field of Search ..... 221/305, 197, 221/34; 229/122, 122.1, 122.2

[56] References Cited

U.S. PATENT DOCUMENTS

| | | | |
|---|---|---|---|
| 2,455,685 | 12/1948 | Lehman | 229/122.2 |
| 2,626,197 | 1/1953 | Kollock | 221/197 |
| 3,568,883 | 3/1971 | Reynolds | 221/305 |
| 4,170,325 | 10/1979 | Pawlowski et al. | 229/17 B |
| 4,382,526 | 5/1983 | Stone | 221/34 |
| 4,739,922 | 4/1988 | Zimmermann | 229/122.1 |
| 5,370,220 | 12/1994 | Wang | 206/44.12 |

FOREIGN PATENT DOCUMENTS

| | | | |
|---|---|---|---|
| 239992 | 3/1961 | Australia | 229/122.1 |

*Primary Examiner*—Kenneth Noland
*Attorney, Agent, or Firm*—Bliss McGlynn, P.C.

[57] ABSTRACT

A dispenser (10) for sequentially dispensing a plurality of stacked articles (12). The dispenser (10) includes a pair of integral side walls (14), back wall (28), and front flanges (22) extending from the side walls (14). The front flanges (22) are spaced from one another to provide an opening (24) along the length of the dispenser (10). A bottom wall (28) is provided integral with the remainder of the dispenser (10) which extends below the side lower edges (18) and is of a smaller surface area than the cross-sectional area established by the remainder of the dispenser (10).

13 Claims, 1 Drawing Sheet

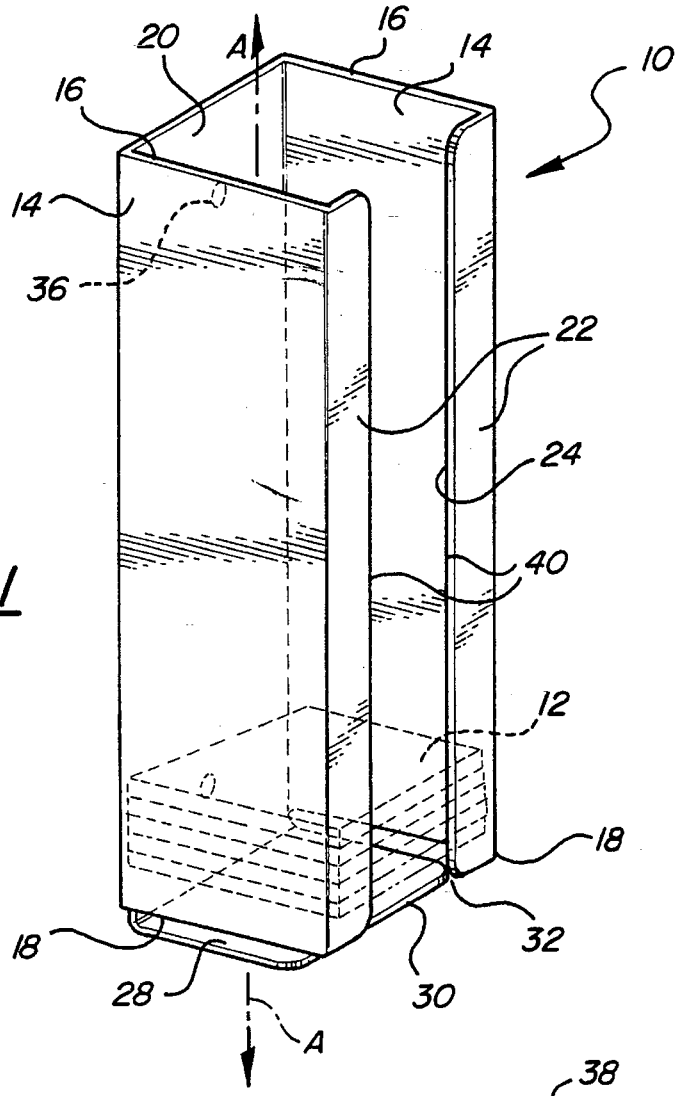
FIG-1
FIG-2
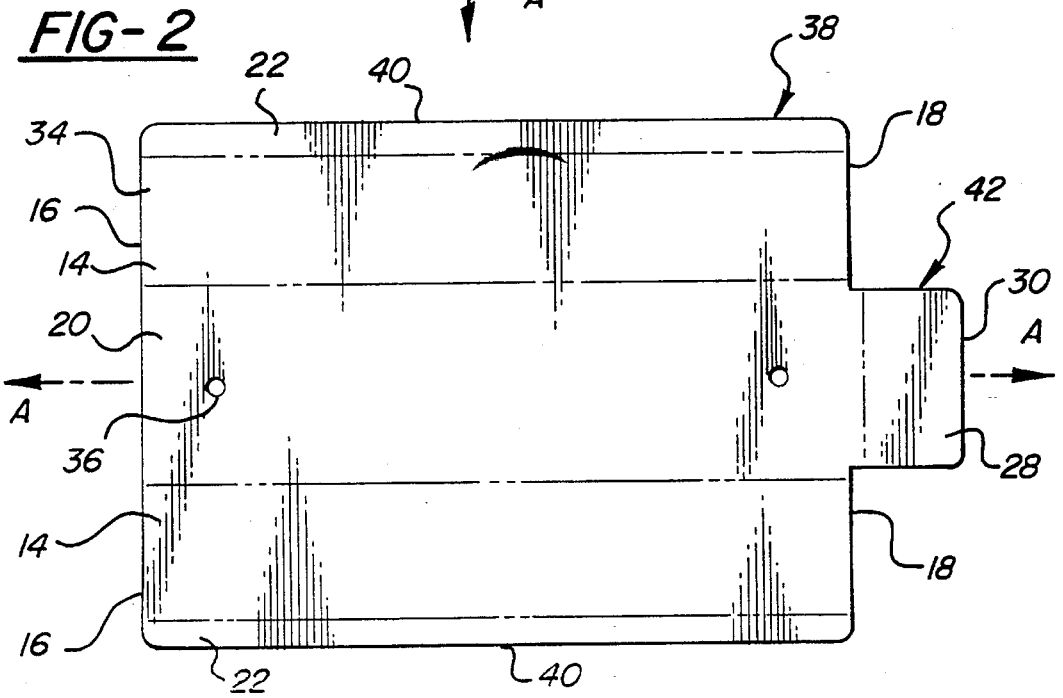

DISPENSER

TECHNICAL FIELD

The invention relates to dispensing containers of the type in which articles are stacked therein and removed article by article from the lower end of the dispenser.

BACKGROUND OF THE INVENTION

Dispensers for containing and dispensing stacked articles are commonly known in the art. Such dispensers commonly include a lower opening therein for allowing withdrawal of one article at a time. Many dispensers are formed from folded sheet material. Exemplary of such system is U.S. Pat. No. 4,739,922, issued Apr. 26, 1988 in the name of Zimmermann. Other such dispensers include U.S. Pat. Nos. 3,568,883 and 2,455,685 and 4,170,325 and 4,382,526 and 5,370,220.

It is desirable to produce a simple dispenser which is easy to manufacture with decreased cost and manufacturing time.

SUMMARY OF THE INVENTION

The invention relates to a dispenser apparatus and a method of making same for supporting and allowing withdrawal of a plurality of stacked articles. The apparatus includes a pair of opposing side walls having upper and lower edges. A back wall is connected to the side walls. The side walls each include a front flange connected substantially perpendicular to the side walls and the opposing the back wall forming a portion of a front side of the apparatus. The front flanges of the side walls are spaced from one another. A bottom wall is connected to the back wall and spaced from the lower edges of the side walls.

The methods includes the steps of forming a sheet of material of substantially rectangular shape providing an upper and lower edge longitudinally spaced from one another and a pair of side edges extending between the upper and lower edges, and a tab extending outwardly from the lower edge for a length in a central position thereof. The sheet of material is then bent to form a back wall extending between the tab and upper edge having a width greater than a width of the tab, and a pair of opposing side walls adjacent the back wall each having a width greater than the length of the tab, a pair of front flanges opposing the back wall and spaced from one another, and bottom wall spaced from the lower edge providing a support for receiving the articles.

Such a dispenser is adapted to be permanently displayed on a wall, and durable in material. The simplicity and elegance in design is pleasing to display and easy to manufacture. The continuously open front allows easy access to dislodge any jammed article to be dispensed.

FIGURES IN THE DRAWINGS

Other advantages of the present invention will be readily appreciated as the same becomes better understood by reference to the following detailed description when considered in connection with the accompanying drawings wherein:

FIG. 1 is a perspective view of the subject invention in a formed state; and FIG. 2 is a plan drawing of the sheet of material formed into the dispenser apparatus.

DESCRIPTION OF THE PREFERRED EMBODIMENT

A dispenser apparatus 10 for supporting and allowing sequential withdrawal of a plurality of stacked articles 12 is illustrated in FIG. 1. The dispenser apparatus 10 is utilized for dispensing generally rectangular, relatively flat articles 12 of consistent or substantially uniform size, such as sugar packets, newspapers, etc. The size of the dispenser apparatus 10 is dependent any the article 12 being dispensed, and may be of any size and relative proportion. It is within the scope of the art to appreciate other such articles may be dispensed from the dispenser apparatus 10.

The dispenser apparatus 10 includes a pair of longitudinally extending and opposing side walls 14 having upper and lower edges 16, 18. A back wall 20 is connected to and between the side walls 14. Both the side walls 14 and back wall 20 extend along a longitudinal axis A. The longitudinal length of the back wall 20 is slightly greater than the longitudinal length of the side walls 14. The width of each of the side walls 14 and back wall 20 is generally less than the longitudinal length.

The side walls 14 each include a front flange 22 connected substantially perpendicular to the side walls 14 and opposing the back wall 20 forming a portion of a front side or front plane of the dispenser apparatus 10. The front flanges 22 are spaced from one another providing a longitudinal opening 24 along the front side. The longitudinal opening 24 extends the entire length of the side walls 14. Each of the upper and lower corners of the front flange 22 extending adjacent the longitudinal opening 24 are generally rounded or radius to one quarter inch to provide easier access and elegance in design, and safe operation in withdrawal of the articles 12.

A bottom wall 28 is connected to the back wall 20 and spaced from the lower edges 18 of the side walls 14. The bottom wall 28 provides a support base for the articles 12. In the preferred embodiment, the bottom wall 28 includes a front edge 30. The front edge 30 is spaced from the front flanges 22. Furthermore, the bottom wall 28 is longitudinally spaced from the lower edges 18 of the side walls 14 along the longitudinal axis A. Each of the side walls 14 establish a side plane, respectively, parallel to one another. The bottom wall 28 is spaced inwardly from the side planes so as to establish a bottom surface area of the bottom wall 28 less than a cross sectional area established between the side walls 14, back wall 28, and front flange 22 or front side plane. Furthermore, the front flanges 22 establish the front plane, and the bottom wall 28 is spaced inwardly of the front plane as illustrated in FIG. 1.

In other words, the bottom wall 28 provides a gap or access opening 32 between the lower edges 18 of the side walls 14 and the bottom wall 28. This gap allows for the articles 12 to be pulled outwardly and downwardly from the dispenser apparatus 10.

The back wall 20 of the dispenser apparatus 10 includes a pair of mounting holes 36 therethrough to receive a fastener (not shown) to mount the dispenser apparatus 10 to a support fixture, such as a wall, cupboard, etc.

The side walls 14, back wall 20, front flanges 22 and bottom wall 28 are comprised of an integral sheet of material 34.. In the preferred embodiment, the sheet of material comprises sheet metal. However, it is to be understood that other materials may be used, such as plastic, natural or synthetic composites, injectable molding material, etc.

The cut sheet material 34 is illustrated in FIG. 2 with fold lines indicated thereon.

The invention also includes a method of making the apparatus 10. The method includes the steps of forming the sheet of material 34 of substantially rectangular shape. 38 providing the upper and lower edges 16, 18 longitudinally spaced from one another and a pair of side edges 40 extending between the upper and lower edges 16, 18. A tab 42 extends from the lower edge 18 in a central position thereof. Holes 36 are cut along a longitudinal center line A for mounting. Thereafter, the sheet of material 34 is bent (along fold lines indicated in FIG. 2) to form the pair of front flanges 22 opposing the back wall 20 in a plane substantially parallel therewith, and which are spaced from one another to provide a longitudinal opening 24. Thereafter, the bottom wall 28 is bent to be spaced from the lower edge 18 providing a support for receiving the articles 12. Then, the pair of opposing side walls 14 are bent to be adjacent the back wall 20 and perpendicular thereto, each having a width greater than the length of the tab 42. The back wall 20 extends between the tab and upper edge 16 having a width greater than a width of a tab 42.

To better illustrate the teachings of the invention, the following dimensions are utilized to show the proportionalities on one embodiment of the invention; however, it is to be appreciated that other dimensions are clearly within the scope of the invention as required by the article 12 being dispensed. Side walls (14)=2.625 wide, back wall (20)=2.313 wide and 0.125 longer than sidewalls, front flanges (22)=0.5 wide, bottom wall (28)=2.063 (width) and 2.0 length. The longitudinal length can easily vary of the upper end 16.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A dispenser apparatus (10) for supporting and allowing withdrawal of a plurality of separate articles (12), said apparatus comprising:

a pair of opposing side walls (14) having upper (16) and lower (18) edges;

a back wall (20) integrally connected to said side walls (14);

said side walls (14) each including a front flange (22) integrally connected and substantially perpendicular to said side walls (14) and opposing said back wall (20) forming a portion of front side of said apparatus (10), said front flanges (22) spaced from one another providing a longitudinal opening (24), said side walls and said back wall directly contacting the plurality of separate articles; and a bottom wall (28) integrally connected to said back wall (20) and spaced from said lower edges (18) of said side walls (14) and directly contacting and supporting the plurality of separate articles.

2. An apparatus as set forth in claim 1 wherein said bottom wall (28) includes a front edge (30), said front edge being spaced from said front flanges (22).

3. An apparatus as set forth in claim 2 wherein said side walls (14) extend along a longitudinal axis, said bottom wall (28) longitudinally spaced from said lower edges (18) of said side walls (14) along said longitudinal axis.

4. An apparatus as set forth in claim 3 wherein each of said side walls (14) establish side planes said bottom wall (28) spaced inwardly of said side planes so as to establish a bottom surface area of said bottom wall (28) less than a cross-sectional area established between said side walls (14), back wall (20) and front flanges (22).

5. An apparatus as set forth in claim 4 wherein said front flanges (22) establish a front plane, and said bottom wall (28) is spaced inward of said front plane.

6. An apparatus as set forth in claim 5 wherein said side walls (14), back wall (20), front flanges (22), and bottom wall (28) are comprised of a bent integral sheet of material.

7. An apparatus as set forth in claim 6 wherein said sheet of material comprises sheet metal.

8. An apparatus as set forth in claim 1 wherein said side walls (14), back wall (20), front flanges (22), and bottom wall (28) are comprised a bent integral sheet of material.

9. An apparatus as set forth in claim 8 wherein said sheet of material comprises sheet metal.

10. A method of making a dispenser (10) for supporting and allowing withdrawal of a plurality of stacked articles (12), the method including the steps of:

forming a sheet of material (34) of substantially rectangular shape (38) including upper (16) and lower (18) edges longitudinally spaced from one another and a pair of side edges (40) extending between the upper (16) and lower (18) edges, and a tab (42) extending from lower edge (18) in a central position thereof, bending the sheet of material (34) to form a back wall (20) extending between the tab (42) and upper edge (16) having a width greater than a width of the tab (42), and a pair of opposing side walls (14) adjacent the back wall (20) each having a width greater than an length of the tab (42), a pair of front flanges (22) opposing the back wall (20) and spaced from one another, and a bottom wall (20) spaced from the lower edge providing a support for receiving the articles (12).

11. A dispenser apparatus (10) for supporting and allowing withdrawal of a plurality of articles (12), said apparatus comprising:

a pair of opposing side walls (14) having upper (16) and lower (18) edges;

a back wall (20) connected to said side walls (14);

said side walls (14) each including a front flange (22) connected substantially perpendicular to said side walls (14) and opposing said back wall (20) forming a portion of front side of said apparatus (10), said front flanges (22) spaced from one another providing a longitudinal opening (24); and a bottom wall (28) connected to said back wall (20) and spaced from said lower edges (18) of said side walls (14), said bottom wall (28) includes a front edge (30) spaced from said front flanges (22).

12. A dispenser apparatus (10) for supporting and allowing withdrawal of a plurality of articles (12), said apparatus comprising:

a pair of opposing side walls (14) having upper (16) and lower (18) edges;

a back wall (20) connected to said side walls (14);

at least one of said side walls (14) including a front flange (22) connected substantially perpendicular to said side wall (14) and opposing said back wall (20) forming a portion of front side of said apparatus (10), said front flange (22) spaced from the other of said sidewalls providing a longitudinal opening (24); and a bottom wall (28) connected to said back wall (20) and spaced from said lower edges (18) of said side walls (14), said bottom wall (28) includes a front edge (30) spaced from said front flange (22).

13. A dispenser apparatus (10) for supporting and allowing withdrawal of a plurality of articles (12), said apparatus comprising:

a pair of opposing side walls (14) having upper (16) and lower (18) edges;

a back wall (20) connected to said side walls (14);

said side walls (14) each including a front flange (22) connected substantially perpendicular to said side walls (14) and opposing said back wall (20) forming a portion of front side of said apparatus (10), said front flanges (22) spaced from one another providing a longitudinal opening (24); and a bottom wall (28) connected to said back wall (20) and said bottom wall (28) includes a front edge (30), said front edge being spaced from said front flanges (22).

* * * * *